United States Patent [19]

Gross

[11] 4,004,180

[45] Jan. 18, 1977

[54] TRAVELING WAVE TUBE WITH RECTANGULAR COUPLING WAVEGUIDES

[75] Inventor: Franz Gross, Munich, Germany

[73] Assignee: Siemens Aktiengesellschaft, Berlin & Munich, Germany

[22] Filed: June 9, 1975

[21] Appl. No.: 585,079

[52] U.S. Cl. ..... 315/3.5; 315/3.6; 315/39.3; 315/39.53

[51] Int. Cl.[2] ..... H01J 25/34

[58] Field of Search ..... 315/3.5, 3.6, 39.3, 315/39.53

[56] References Cited

UNITED STATES PATENTS

| | | | |
|---|---|---|---|
| 2,936,395 | 5/1960 | Everhart | 315/3.5 |
| 2,966,610 | 12/1960 | Schmidt | 315/3.5 |
| 3,157,814 | 11/1964 | Gross | 315/3.5 |
| 3,233,139 | 2/1966 | Chodorow | 315/3.5 |
| 3,532,926 | 10/1970 | Winslow | 315/3.5 |
| 3,668,460 | 6/1972 | James | 315/3.5 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

A broad-band, low-reflection energy coupling or decoupling with a coupled cavity line in a traveling wave tube, particularly high-efficiency traveling field tubes, in which a rectangular hollow conductor is not loaded, and has the opposed walls thereof, of minimum spacing and greatest width, tapering in a direction toward the delay line, with the spacing between such walls at the delay line being approximately that between adjacent transverse walls defining respective cells of the delay line, an inductive shield being provided within the hollow conductor and spaced from the line axis, the coupling opening at the hollow conductor having an open angle larger than the corresponding angle of the coupling openings in the transverse walls of adjacent line cells.

11 Claims, 2 Drawing Figures

TRAVELING WAVE TUBE WITH RECTANGULAR COUPLING WAVEGUIDES

The Invention herein described was made under a subcontract (Prime Contract F 33615-73-C-4036) with the Air Force Avionics Laboratory Air Force System Command U.S. Air Force Wright-Patterson AFB, Ohio.

BACKGROUND OF THE INVENTION

The invention relates to a traveling field tube particularly a high-efficiency traveling wave tube having a magnetic system for the bundled guidance of an electron-beam, which system surrounds a delay line comprising line cells arranged one behind the other, separated from one another by transverse walls, each of which is provided with an opening therein for the passage of the electron beam, and a coupling opening therein extending substantially in circumferential direction, with the delay line coupled, at least at one of its two frontal sides with a rectangular hollow conductor whose broad side adjacent the longitudinal axis of the delay line extends perpendicularly thereto and which conducts at a right angle with respect to the line axis.

Traveling wave tubes constructed in this general manner are known, for example, as illustrated in British Pat. No. 953,488 or German Offenlegungsschrift No. 2,102,230 (see FIG. 1 in conjunction with page 4, third paragraph thereof). In such type of tubes, the rectangular hollow conductor usually is provided with a metallic projection or protuberance which extends longitudinally along the inner wall surface of the hollow conductor opposite to that disposed adjacent the delay line with such structure very closely approaching the delay line adjacent the opening for the passage of the electron beam (which approaches in steps in the cited Letters Patent and in a continuous manner in the cited Offenlegungsschrift) and cooperates with a short circuited line section of high impedance. Such a longitudinal path loading provides a good junction between the comparatively high wave resistance of the delay line and low wave resistance of the hollow conductor and enables a broad-band, low-reflection HF-coupling and decoupling.

However, the favorable matching values are offset by several properties or characteristics which become disadvantageously noticeable where higher powers and higher frequencies are involved, and in particular where a permanent-magnet system is utilized for the spatial periodic bundling of the electron beam (PPM System). Such path loading comprises, for example, edge and corner configurations in the direct area of the frontal coupling opening and electron-beam passage opening of the delay line, which may create high field-strength concentrations and result in arcing when the hollow conductor is employed for energy decoupling. In addition, loaded hollow conductors require dimensions, particularly in the direction of the line axis, which would create inadmissably large interference of the electron bundling in the case of such a permanent-magnet system (PPM).

BRIEF SUMMARY OF THE INVENTION

The present invention is directed to the production of a traveling wave tube with a broad-band matching coupling conductor which, even where highest output efficiencies and frequencies are involved, is resistant to arcing and can thus be utilized with small axial as well as radial dimensions. The desired results are achieved by employing a hollow rectangular conductor without loading, which has the opposite walls of minimum spacing and greatest width tapering in a direction toward the delay line, with the spacing between such walls at the delay line being approximately that between adjacent transverse walls defining the respective cells, the opposite walls of the conductor, maximum spacing and least width, having opposed inwardly directed projections forming a shield, with the wall of the conductor adjacent the delay line having a coupling opening therein whose open angle with respect to the line axis, is larger than the corresponding angle of the coupling openings in the transverse walls of the adjacent line cells.

It has been proven that the transmission properties required for a coupling conductor, and in particular with broad band characteristics, can be obtained without using a path loading or other, for example, sharp edged matching elements by the utilization of a continuous tapering of the hollow conductor in connection with an inductively effective shield and an enlargement or broadening of the frontal coupling opening in the circumferential direction. By the employment of such a combination, the decoupling section of a tube can be maintained free from voltage arcings and the focusing effect of a PPM System will remain without interference in the coupling sections. The invention has a further production advantage in that the coupling section of the present invention comprises a straight shape without curved inclined surfaces, etc. which can be easily processed and may, for example, be produced by an embossing of the individual parts thereof.

In accordance with a further embodiment of the invention, it is possible to further improve the matching values by providing the end wall, terminating the conductor, with a portion of arcuate configuration which is aligned with the edges, of coupling openings, remote from the longitudinal or line axis. Particularly favorable results can be achieved when an arcuate configuration is selected for the coupling openings, with the recess in the end wall of the rectangular conductor being correspondingly arcuately shaped. The matching may be additionally improved, in accordance with the invention, by suitable dimensioning of the frontal line cell of the delay line.

The construction of the invention is particularly applicable to high power traveling field tubes in the millimeter wave range.

BRIEF DESCRIPTION OF THE DRAWINGS

In the drawings wherein like reference characters indicate like or corresponding parts.

DETAILED DESCRIPTION OF THE INVENTION

Figure 1:
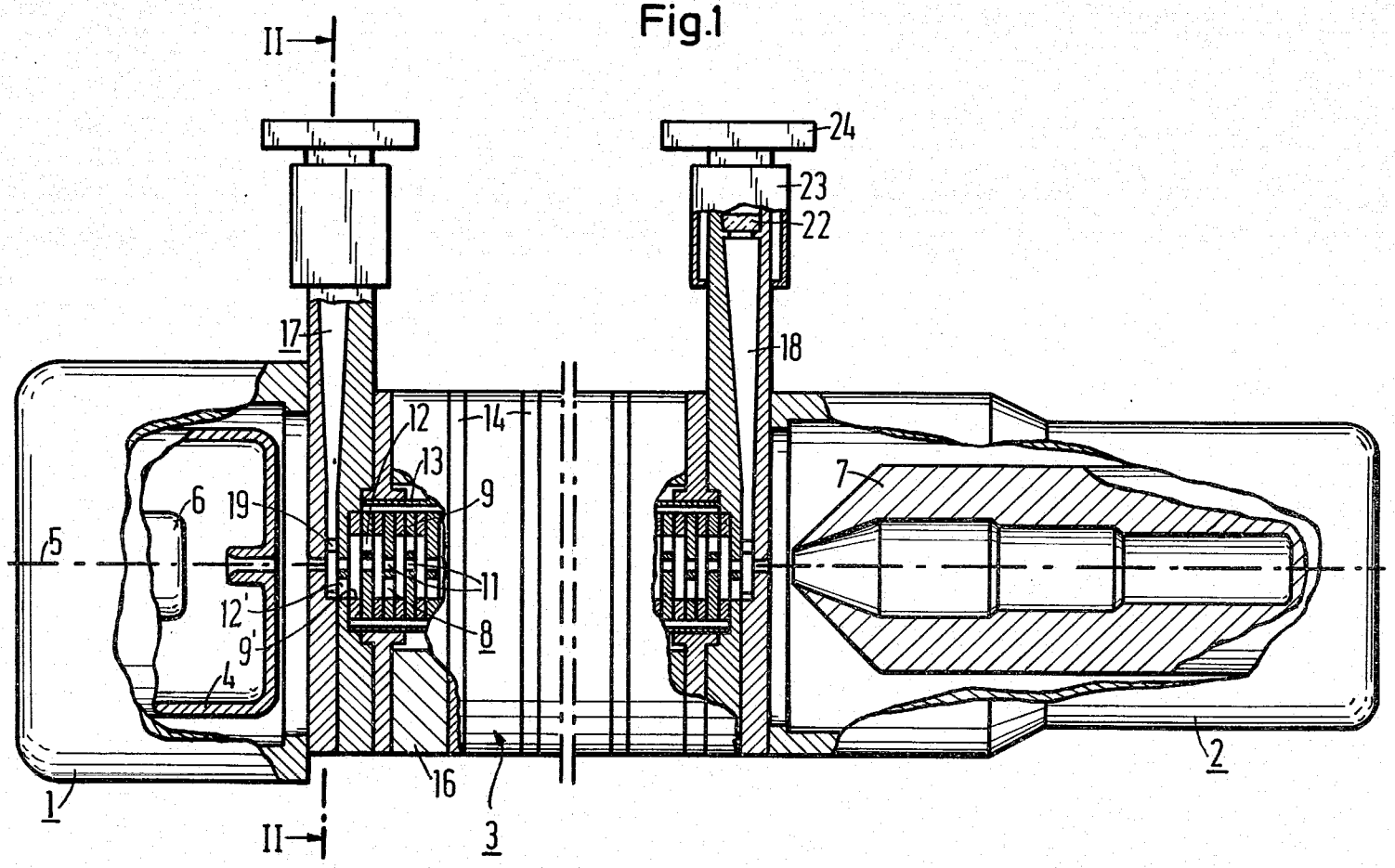
FIG. 1 is an elevational view of a traveling wave tube in accordance with the invention with portions of the structure broken-away to show the details thereof.

Referring to the drawings, in which portions of the traveling wave tube, not required for an understanding of the invention, for example all electrical supply lines, cooling system, etc., have not been illustrated.

FIG. 1 illustrates a high efficiency traveling wave tube which is intended to be operated in the millimeter wave range, in which the tube comprises a part or section 1, which houses the cathode and those may be designated "cathode part", a part 2, housing the electron collector which may be termed the "collector part", and an intermediate section 3 intermediate the first two portions, which contains the interaction structure and may be termed the "center part". As will be apparent from FIG. 1, the cathode part 1 includes a cup-shaped pull or gun anode 4 and the cathode 6, while the collector part 2 surrounds an electron-beam target 7, constructed substantially in the form of a hollow cylinder. Delay line 8 is disposed between the anode 4 and the electron beam collector 7. The delay line is illustrated as being constructed from a plurality of stacked disks 9 and intermediate spacers 9' stacked in conventional manner, in which the elements 9' may be of ring-like configuration forming a circular passage, while the disks 9 are each provided with a central bore 11 which forms the electron beam passage through the delayed line. Each disk is further provided with a coupling opening 12, illustrated as of arcuate configuration. Referring to FIG. 1, it will be noted that the outer peripheral edge of the opening 12 is longitudinally aligned with the corresponding inner edge of the spacer rings 9', and as apparent from FIG. 1, the alternate disks 9 are disposed with the coupling openings 12 each rotated 180° about the axis 5 of the tube, as compared with the adjacent disks. There thus is produced a delay line in the form of coupled hollow spaces or cells with a reverse-moving basic wave. The delay line is surrounded by a metallic vacuum casing 13 which in turn is surrounded by soft-magnetic pole pieces 14, between which are disposed respective annular shaped permanent magnets 16.

For effecting a coupling or decoupling of HF energy, two rectangular hollow conductors, i.e. coupling conductor 17 and coupling conductor 18, are provided, which guide the HF energy to, or away from the line at a right angle from the respective ends of the delay line 8. As will be apparent from FIG. 2, the walls of the hollow conductor of greater spacing i.e. that define the long dimension of the rectangular conductor extend at right angles to a plane containing the longitudinal axis 5 of the delay line, while the walls of the rectangular conductor of lesser spacing taper toward the axis 5 from an upper dimension, as viewed in FIG. 1, substantially equivalent to the corresponding dimension of the hollow conductor to be connected thereto, to a dimension approximately equal to the corresponding dimension of a line cell defined by adjacent disks 9.

Figure 2:
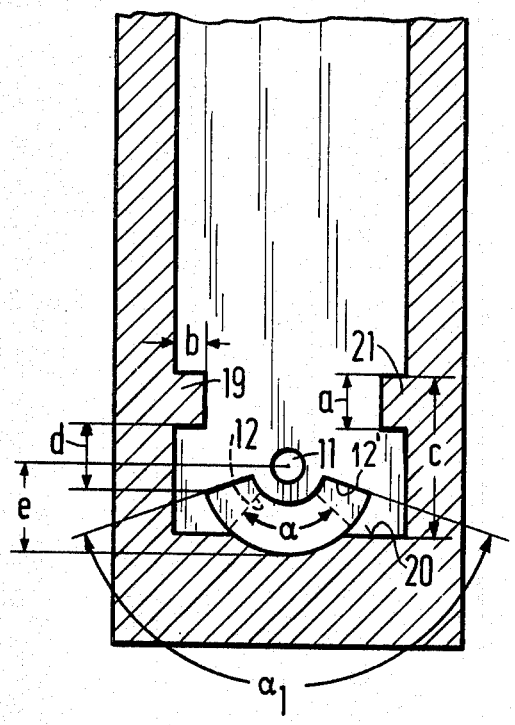
FIG. 2 is a sectional view taken approximately on the line II—II of FIG. 1.

FIG. 2 illustrates the details of the hollow coupling conductor in the vicinity of the axis of the delay line, and it will be noted that the short circuit plane i.e. bottom 20 of the hollow conductor is provided with a recess therein, which in the example is an arcuate shaped surface which is axially aligned with the outer arcuate edge of the adjacent coupling opening 12' in the wall of the conductor, which coupling opening is aligned with the correspondingly disposed coupling openings 12 in alternate disks 9.

Two shield or screen projections 19, 21, forming an inductively effective shield or screen, are provided above the opening 11 for the passage of the electron beam, as viewed in FIG. 2 and are disposed in laterally spaced relation. The thickness of such projections, i.e. in vertical direction as viewed in FIG. 2, is designated by the reference letter *a* while their width is designated by the reference letter *b*, and the distance between the bottom wall 20 to the upper edge of the respective projections is designated by reference letter *c*. In like manner the distance between the corner points of the coupling opening, nearest the bottom 20, i.e. remote from the openings 11, to the adjacent laterally extending wall of the projections is designated by the reference letter *d*. It will be noted from the figure that the coupling opening 12' in the side wall of the conductor is larger than that of the coupling openings 12 in the respective disks 9. The opening angle of the coupling opening 12' is designated $\alpha_1$, while the corresponding opening angle of the coupling openings of the respective disks 9 is designated by $\alpha$. In addition, the distance between the line axis 5 and the outer peripheral edge of the coupling openings is designated by the reference letter *e*.

In the production of traveling wave tubes in accordance with the invention, the following dimensions above referred to have proved to be satisfactory, $\lambda_o$ representing the wave length and free space corresponding to the mean operational frequency of the traveling field tube:

$$0.1\ \lambda_o < a < 0.15\ \lambda_o,\ 0.07\ \lambda_o < b < 0.12\ \lambda_o,\ 0.22\ \lambda_o < c < 0.3\ \lambda_o,\ 0.04\ \lambda_o < d < 0.07\ \lambda_o,\ 0.22\ \lambda_o < e < 0.3\ \lambda_o,\ \alpha < \alpha_1 < 1.2\ \alpha.$$

The following dimensions have proved to be particularly effective for the desired purposes:

$$0.115\ \lambda_o < a < 0.135\ \lambda_o,\ 0.085\ \lambda_o < b < 0.105\ \lambda_o,\ 0.24\ \lambda_o < c < 0.28\ \lambda_o,\ 0.05\ \lambda_o < d < 0.06\ \lambda_o,\ 0.24\ \lambda_o < e < 0.28\ \lambda_o,\ 1.05\ \alpha < \alpha_1 < 1.15\ \alpha.$$

As illustrated in FIG. 1, a HF window 22, of common construction, may be provided in the respective hollow coupling conductors, each window of which is enclosed by a housing 23 which can be constructed for the flow of a cooling liquid. Each hollow conductor may terminate in a flange 24 which may be utilized for effecting the connection of the coupling conductor to a cooperable further hollow conductor.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a traveling wave, particularly high-efficiency traveling field tubes having a magnetic system for the bundled guidance of an electron beam, which system surrounds a delay line comprising line cells arranged one behind the other, separated from one another by transverse walls, each of which is provided with an opening therein for the passage of the electron beam, and a coupling opening therein extending substantially in circumferential direction, with the delay line coupled, at least at one of its frontal sides with a rectangular hollow conductor whose broad side, adjacent the longitudinal axis of the delay line (line axis), extends perpendicular thereto, and which conducts at a right angle with respect to the line axis, the combination of the hollow rectangular conductor, preferably employed in connection with a spatial periodic permanent magnet system (PPM System), without loading, which has the opposite transverse walls of minimum spacing and greatest width tapering in a direction toward the delay line, with the spacing between such walls at the delay line being approximately that between adjacent transverse walls defining the respective cells, the opposite longitudinal side walls of maximum spacing and least width having opposed, inwardly directed projections forming a shield, the transverse wall of said conductor adjacent said delay line having a coupling opening therein whose open angle, with respect to the line axis is larger than the corresponding angle of the coupling openings in the transverse walls of adjacent line cells, and having the following dimensions:

| | | | | | | |
|---|---|---|---|---|---|---|
| 0.1 | $\lambda_o$ | < | a | < | 0.15 | $\lambda_o$ |
| 0.07 | $\lambda_o$ | < | b | < | 0.12 | $\lambda_o$ |
| 0.22 | $\lambda_o$ | < | c | < | 0.3 | $\lambda_o$ |
| 0.04 | $\lambda_o$ | < | d | < | 0.07 | $\lambda_o$ |
| 0.22 | $\lambda_o$ | < | e | < | 0.3 | $\lambda_o$ |
| | $\alpha$ | < | $\alpha_1$ | < | 1.2 | $\alpha$ |

in which $a$ = thickness of the shield projections $b$ = width of the shield projections $c$ = the distance between the end wall of the hollow conductor and the remote wall of the shield projections $d$ = the distance between the shield projections and the coupling opening, the corner points of the arcuate shaped coupling opening remote from the line axis $e$ = the distance between the line axis and the remote edge of the coupling opening $\alpha_1$ = the open angle of the coupling opening at the hollow conductor $\alpha$ = the open angle of the remaining coupling openings in the cell walls $\lambda_o$ = the wavelength and free space corresponding to the mean operational frequency of the traveling field tube.

2. A traveling field tube according to claim 1, having the following dimensions:

| | | | | | | |
|---|---|---|---|---|---|---|
| 0.115 | $\lambda_o$ | < | a | < | 0.135 | $\lambda_o$ |
| 0.085 | $\lambda_o$ | < | b | < | 0.105 | $\lambda_o$ |
| 0.24 | $\lambda_o$ | < | c | < | 0.28 | $\lambda_o$ |
| 0.05 | $\lambda_o$ | < | d | < | 0.06 | $\lambda_o$ |
| 0.24 | $\lambda_o$ | < | e | < | 0.28 | $\lambda_o$ |
| 1.05 | $\alpha$ | < | $\alpha_1$ | < | 1.5 | $\alpha$ |

3. A traveling field tube according to claim 1, wherein the coupling openings have an arcuate configuration.

4. A traveling field tube according to claim 3, having the following dimensions:

| | | | | | | |
|---|---|---|---|---|---|---|
| 0.1 | $\lambda_o$ | < | a | < | 0.15 | $\lambda_o$ |
| 0.07 | $\lambda_o$ | < | b | < | 0.12 | $\lambda_o$ |
| 0.22 | $\lambda_o$ | < | c | < | 0.3 | $\lambda_o$ |
| 0.04 | $\lambda_o$ | < | d | < | 0.07 | $\lambda_o$ |
| 0.22 | $\lambda_o$ | < | e | < | 0.3 | $\lambda_o$ |
| | $\alpha$ | < | $\alpha_1$ | < | 1.2 | $\alpha$ |

in which $a$ = thickness of the shield projections $b$ = width of the shield projections $c$ = the distance between the end wall of the hollow conductor and the remote wall of the shield projections $d$ = the distance between the shield projections and the coupling opening, the corner points of the arcuate shaped coupling opening remote from the line axis $e$ = the distance between the line axis and the remote edge of the coupling opening $\alpha_1$ = the open angle of the coupling opening at the hollow conductor $\alpha$ = the open angle of the remaining coupling openings in the cell walls $\lambda_o$ = the wavelength and free space corresponding to the mean operational frequency of the traveling field tube.

5. A traveling field tube according to claim 4, having the following dimensions:

| | | | | | | |
|---|---|---|---|---|---|---|
| 0.115 | $\lambda_o$ | < | a | < | 0.135 | $\lambda_o$ |
| 0.085 | $\lambda_o$ | < | b | < | 0.105 | $\lambda_o$ |
| 0.24 | $\lambda_o$ | < | c | < | 0.28 | $\lambda_o$ |
| 0.05 | $\lambda_o$ | < | d | < | 0.06 | $\lambda_o$ |
| 0.24 | $\lambda_o$ | < | e | < | 0.28 | $\lambda_o$ |
| 1.05 | $\alpha$ | < | $\alpha_1$ | < | 1.15 | $\alpha$ |

6. A traveling field tube according to claim 5, wherein the coupling openings have an arcuate configuration.

7. A traveling field tube according to claim 1, wherein the coupling openings have an arcuate configuration.

8. A traveling field tube according to claim 1, wherein the rectangular hollow conductor is terminated by an end wall having a recess therein, which is generally aligned in line-axial direction with the edges, of coupling openings, remote from the line axis.

9. A traveling field tube according to claim 3, wherein the rectangular hollow conductor is terminated by an end wall having a portion of arcuate configuration, which is aligned in line-axial direction with the edges, of coupling openings, remote from the line axis.

10. A traveling field tube according to claim 9, having the following dimensions:

| | | | | | | |
|---|---|---|---|---|---|---|
| 0.1 | $\lambda_o$ | < | a | < | 0.15 | $\lambda_o$ |
| 0.07 | $\lambda_o$ | < | b | < | 0.12 | $\lambda_o$ |
| 0.22 | $\lambda_o$ | < | c | < | 0.3 | $\lambda_o$ |
| 0.04 | $\lambda_o$ | < | d | < | 0.07 | $\lambda_o$ |
| 0.22 | $\lambda_o$ | < | e | < | 0.3 | $\lambda_o$ |
| | $\alpha$ | < | $\alpha_1$ | < | 1.2 | $\alpha$ |

in which $a$ = thickness of the shield projections $b$ = width of the shield projections $c$ = the distance between the end wall of the hollow conductor and the corresponding wall of the shield projections $d$ = the distance between the shield projections and the coupling opening, the corner points of the arcuate shaped coupling opening remote from the line axis $e$ = the distance between the line axis and the remote edge of the coupling opening $\alpha_1$ = the open angle of the coupling opening at the hollow conductor $\alpha$ = the open angle of the remaining coupling openings in the cell walls $\lambda_o$ = the wavelength and free space corresponding to the mean operational frequency of the traveling field tube.

11. A traveling field tube according to claim 10, having the following dimensions:

| | | | | | | |
|---|---|---|---|---|---|---|
| 0.115 | $\lambda_o$ | < | a | < | 0.135 | $\lambda_o$ |
| 0.085 | $\lambda_o$ | < | b | < | 0.105 | $\lambda_o$ |

-continued

| | | | | | | |
|---|---|---|---|---|---|---|
| 0.24 | $\lambda_o$ | < | c | < | 0.28 | $\lambda_o$ |
| 0.05 | $\lambda_o$ | < | d | < | 0.06 | $\lambda_o$ |
| 0.24 | $\lambda_o$ | < | e | < | 0.28 | $\lambda_o$ |
| 1.05 | $\alpha$ | < | $\alpha_1$ | < | 1.15 | $\alpha$ |

* * * * *